United States Patent [19]

Langan

[11] Patent Number: 4,719,073

[45] Date of Patent: Jan. 12, 1988

[54] METHOD OF MONITORING AN ARTICLE IN SINTERING FURNACE

[76] Inventor: John D. Langan, 6895 Sabado Tarde, Goleta, Calif. 93117

[21] Appl. No.: 824,123

[22] Filed: Jan. 30, 1986

[51] Int. Cl.[4] ..... C22C 1/04

[52] U.S. Cl. ..... 419/1; 73/26; 73/27 R; 264/56; 264/125; 264/65; 266/44; 266/79; 266/80; 419/60

[58] Field of Search ..... 419/1, 60; 73/27 R, 73/26; 266/79, 80, 44; 264/56, 125, 65

[56] References Cited

U.S. PATENT DOCUMENTS

| | | | |
|---|---|---|---|
| 4,288,062 | 9/1981 | Gupta et al. | 266/80 |
| 4,410,632 | 10/1983 | Dilley et al. | 73/27 R |
| 4,509,727 | 4/1985 | Davis et al. | 266/79 |
| 4,541,988 | 9/1985 | Tozier et al. | 73/27 R |

*Primary Examiner*—Stephen J. Lechert, Jr.

[57] ABSTRACT

A process and apparatus for measuring and regulating the variable pressure furnace gas chemistry is described. The method makes use of mass spectrometer measurements, in the preferred form of the invention, in which gas species percent composition is obtained quantitatively independent of total furnace pressure variation. Using such a real time measurement capability, active control of batch process furnace operations is possible by intrinsic measurement of the part outgassing rather than by assumption of batch part status as a function of extrinsic parameters such as temperature and total pressure. Thus, by a combination of batch process temperature ramp control and variable admittance of suitable gas into the furnace, uniform batch processing is possible by closed loop control, due to renormalization of furnace residual gas chemistry from day to day drift and from batch part chemistry variation. Quantitative measurements of the variable residual pressure is made possible by adjusting in real time the throughput into the mass spectrometer indpendent of the total pressure variation in the furnace. These measurement means also make possible the real time determination of sinter part densification in vacuum furnaces by measurement of the part outgassing attenuation during pore closure.

6 Claims, 3 Drawing Figures

METHOD OF MONITORING AN ARTICLE IN SINTERING FURNACE

BACKGROUND OF THE INVENTION

This invention relates to a method of measurement and closed loop control in vacuum, reduced and overpressure furnace operations by measurement of actual part outgassing as an indicator of the actual state of the parts. With this information corrections can be made automatically as required via microprocessor control of the extrinsic conditions in a feedback loop.

Powder metallurgical operations and the like in the vacuum environment are often affected by the residual chemical atmosphere created by the outgassing from both the furnace and the parts. The atmosphere itself gives valuable intrinsic information about the state of the parts being processed through their outgassing even if the actual furnace atmosphere chemistry is unimportant in affecting part processing. The effect in terms of the atmosphere oxidizing/reducing character, or the carburizing/decarburizing character, as examples of this type of information, is usually dependent upon ratios of residual gas species rather than upon the absolute magnitude of the individual partial pressures alone. Specifically, for example, the hydrogran to water and the carbon monoxide to carbon dioxide ratios are important in determining the oxidizing/reducing character, as is well known. In another example, methane divided by the square of the hydrogen concentration is significant in determining the carburizing/decarburizing potential of the furnace in certain systems such as tungsten carbide. For this reason measurement of the percent composition of the residual gases in reduced pressure metallurgy and ceramic processes is generally sufficient for control and characterization purposes. This has advantages in minimizing absolute calibration common mode errors of the spectrum of gases measured.

In the case of carbon control, best known approaches to atmosphere adjustment in a vacuum sintering furnace consist of either admitting a predetermined gaseous atmosphere such as hydrogen in particular segments of the sinter batch cycle or in deliberately allowing the furnace to achieve a given degree of chemical contamination. As an example of this later approach, sometimes a deliberate excess of binder material is added to the furance; or periodically the furnace is heated up without parts to burn off excess contamination; or even more periodically rebuilt in terms of the internal insulation and exposed surfaces. All of these approaches are used depending upon the degree of carburizing and decarburizing that is desired for a given product.

In metallurgical or ceramic systems where carbon control is not the issue, control may depend upon following an evolution schedule such as determining that a particular gas percentage composition or ratio is depleted or increased in some functionally appropriate fashion. These control attributes of the batch cycle extrinsic conditions in turn will depend upon the final properties desired and the particular type of powder being used for a given product as determined by analytical assessment before part pressing and also by experience of post hoc metallurgical examination of recent parts from a given process. Other technologies require batch cycles with temperature profiles so as to completely degas the parts in accord with predetermined temperature regimes, for a given gas species which may not be the most significant contributor to the total pressure and thus are unobserved with conventional instrumentation. Therefore a situation can result where nominal conditions are, of necessity, presumed (incorrectly) to apply to all production heats.

All of these prior approaches have in common the feature that in addition to their lack of precise control, none depend upon in situ measurement of the real time furnace/part conditions. Furthermore, except for deliberately admitting a predetermined gas quantity, none have any specificity with respect to differing sinter cycle segements which themselves may require differing chemical atmospheres. For example, the delube portion of the cycle for tungsten carbide normally benefits by a reduction of the lubricant remnants and surface oxides while the remaining segments normally are ideally more neutral. It is one object of this invention to provide a generalized control algorithm feature which will enable an operator to easily program an appropriate control mode for a given process based upon intrinsic measurements for the part/furnace atmospheric constituents.

A prior art attempt to control a batch operation in a heat processing furnace is shown in U.S. Pat. No. 4,288,062 to Gupta et al. In this patent, a system is described for the monitoring and control of the carbon content of the atmosphere of a furnace such as a one atmosphere carburizing heat processing furnace for steel parts. This patent suggests the use of an infrared analyzer for the measurement of absorbed CO and $CO_2$. It is to be noted however that certain components of the atmosphere of a furnace such as a vacuum furnace which would be useful in control of such furnace cannot be measured according to the Gupta disclosure and inasmuch as important measurable gases such as hydrogen and nitrogen are wholly or substantially invisible to infrared. Furthermore, obvious problems exist with regard to vacuum pressure levels in using the infrared approach. Thus, outside the constant one atmosphere surface carburizing environment, the Gupta patent does not disclose a method of controlling metallurgical processes as for example in a vacuum furnace. While Gupta et al suggests that other means of analysis might be used, it is not indicative that such analysis could be used on gases other than CO and $CO_2$ nor how the variable total pressure conditions as in vacuum metallurgy could be handled for quantitative measurement. Besides the foregoing, a major distinction between the approach outlined in this invention and that of Gupta et al is that in a vacuum, or a reduced pressure environment, sensitive real time general techniques like mass spectrometry have the ability to measure intrinsic outgassing effects and thus the actual state of the parts, rather than just the carbon potential or other characteristics of an extrinsic environment provided for them.

A good example of this intrinsic measurement ability of real time part properties and a further object of this invention is the determination of pore closure. In certain powder metallurgy and ceramic operations, the determination of the actual time of sinter pore closure and thus densification is of great importance in part processing. According to this aspect of the invention, such determination is accomplished by measuring the outgassing rate of gas which is principally, although not limited to, nitrogen from the internal pores of the sintered parts as it undergoes densification. The resulting output curve, obtained by monitoring the furnace partial pressure of the gas in question, shows the effect of such outgassing being attenuated since the pore closure decreases the conductance of such gas from the sintered part. The novel aspect of this invention is that it makes use of an existing physical phenomenon: the presence of gas in the incompletely sintered pores to produce a signal proportional to the degree of pore closure since this gas partial pressure can be measured in the furnace after its conductance through the sintered part. By observation of such a curve in real time, the current degree of sinter densification can be determined since densification corresponds to pore shrinkage which, in turn, attenuates the conductance of the internal gas from the sintered part into the furnace. The structure of the attenuation curve also reveals information as to the spatial homogeneity of the densification process over the furnace load. If temperature is not uniform within the hot zone, each part densifies corresponding to its own temperature which in turn superimposes the gas evolution attenuation effect for the net gas signal measured. This has a characteristic profile which can be deconvolved to provide valuable information on the real time processing homogeneity.

The classical problem in such sintering measurements is that thermometry can be, and usually is, as much as hundreds of degrees off the true temperature of the furnace parts. Thus, great difficulty is encountered in correctly implementing, in time sequence, the proper sintering events based on measurements of temperature. For example, in some cases subsequent efforts following pore closure at higher temperature to prevent liquid phase species removal by evaporation involve allowing the furnace pressure to rise. If this is allowed to happen prior to complete pore closure (densification), the result is incomplete sinter part degassing. Since the relationship between the temperature, as read by the thermocouple system, and the furnace part load varies with many factors such as the current size of the load (thermal mass), great inaccuracy can result leading to a seriously uncontrolled process.

Best known prior art approaches to measurement of part densification in real time involve the use of dilatometry which is a laboratory tool not amenable to use in the production environment. Otherwise, the sinter process relies on temperature measurement to determine the state of the sinter cycle at a given time. As we have described above, this is very unrealiable and, in fact, the relationship between the temperature of a measurement thermocouple and a true temperature of the furnace parts can vary widely from run to run. Thus, the process invention described here provides the first useful production method to make use of intrinsic in situ information.

GENERAL DESCRIPTION OF THE INVENTION

According to this invention, there is provided a method and apparatus for the monitoring and control of a variable pressure batch process sintering or heating furnace which provides for continuously withdrawing a residual gas sample from the atmosphere of the furnace, measuring the percent composition of certain constituents of said gas sample, and varying the throughput of said gas sample to measurement means so that variations in furnace total pressure will not effect measurement of the percent composition of the constituents. This is required since measurement means such as mass spectrometers, as in the preferred form of this invention, perform their operation at pressures well below those existing normally in the furnace. Consequently, means are provided to variably reduce the furnace gas pressure for admittance to the mass spectrometer in proportion to the changing furnace pressure. This procedure serves to provide the correct operating conditions for the mass spectrometer with any remaining common mode errors eliminated via the method outlined in U.S. Pat. No. 3,648,047. A provision is also made for measuring the temperature and total pressure in the furnace.

Using this information it is possible, via real time computer capability, to calculate derived quantities which are functions of measured temperature, total pressure and percent compositions. These quantities compared with predetermined optimal process values are input to a PID loop used in controlling the furnace temperature rate with time in response to this comparison. Input gas to the furnace is also controlled, by this method, in response to said derived quantities.

As one example, once such information is obtained, it can be determined whether the system is or is not in equilibrium with respect to the water gasses since the water gas equilibrium is controlled by the following equation:

$$CO + H_2O \rightleftharpoons CO_2 + H_2$$

If the system is not in equilibrium, the measured value for the equilibrium constant $$K = \frac{[P_{H_2}/P_{H_2O}]}{P_{CO}/P_{CO_2}]}$$

where P=the partial pressure of the gas in the furnace atmosphere, will not be coincident with the well known theoretical values which are a function of the furnace temperature. In this case, the computer can instruct a mass flow controller to admit the correctly determined throughput of the appropriate gasses to bring the system back equilibrium. However, this can be done in a manner such that the individual values of the ratios of $H_2/H_2O$ and $CO/CO_2$ correspond to the desired oxidizing/reducing or neutral conditions. These values may be calculated from the oxidation reaction as a function of temperature paramaterized for the specific pressure. Such information may be prestored within the computer.

Concurrently, according to this invention, the computer may be in active real time control of the sinter furnace temperature controller so as to increase or decrease the current temperature ramp rate in the sinter batch cycle. This has the effect of also adjusting the furnace chemistry through differential part outgassing of differing gas species effecting the indicative ratios. The sensitivity for the temperature ramp effect may be predetermined and stored within the computer. Real time temperature ramp control is especially indicated for bulk property control where in some instances the renormalization of furnace atmosphere is ineffective except for surface properties.

The overall effect of both chemistry control methods described above is one of closed loop control so as to keep the actual furnace and/or internal part chemistry at the desired state throughout the batch cycle. Obviously, the algorithm just described applies to other aspects such as the carburizing potential via measurement of such quantities as the $[PCH_4/PH_2^2]$ ratio or any other predetermined optimal process part outgas schedule.

In another aspect of this invention, there is provided a method of process control and apparatus for determining in real time the dimensional shrinkage characteristics and part uniformity of an article being sintered in a metallurgical furnace during the sintering operation. Observation of this effect can be used as a unique intrinsic calibration of the process. Such method and apparatus provide for the withdrawing of a gas sample from the atmosphere of the furnace and measuring the percent composition of a component of said gas sample, such component including a gas at least in part attenuated from said part due to pore closure during densification. In a preferred form of the invention, the gas component is nitrogen, which naturally occurs during presintering part pressing in many cases.

Since the true temperature of the sinter parts (spatial inhomogeneity apart) is unique at a given stage of densification, this fact can be used as an intrinsic calibration of the thermometry system for normalization to true sinter part temperature. This ability then allows a more precise process sequence to be maintained.

The method also has potential advantages in such applications as sinter hot isostatic pressing where one would wish to determine precisely when complete outgassing had occurred before commencing the high pressure uniform stress phase. For the same reasons as mentioned earlier, it is important that complete outgassing be accomplished in order to avoid entrapped gas. This could clearly not be avoided were the high pressure allowed to begin before complete pore closure. Other applications include ceramic processes like silicon nitride sintering and general powder metallurgy processes like the refactory and hard metal vacuum processes. For example some aspects of powder metal injection molding could benefit from this invention in order to minimize inordinately long delubrication cycles.

DESCRIPTION OF THE DRAWINGS

The invention will be more fully understood with reference to the accompanying drawings in which.

DETAILED DESCRIPTION OF THE DRAWING

Figure 1:
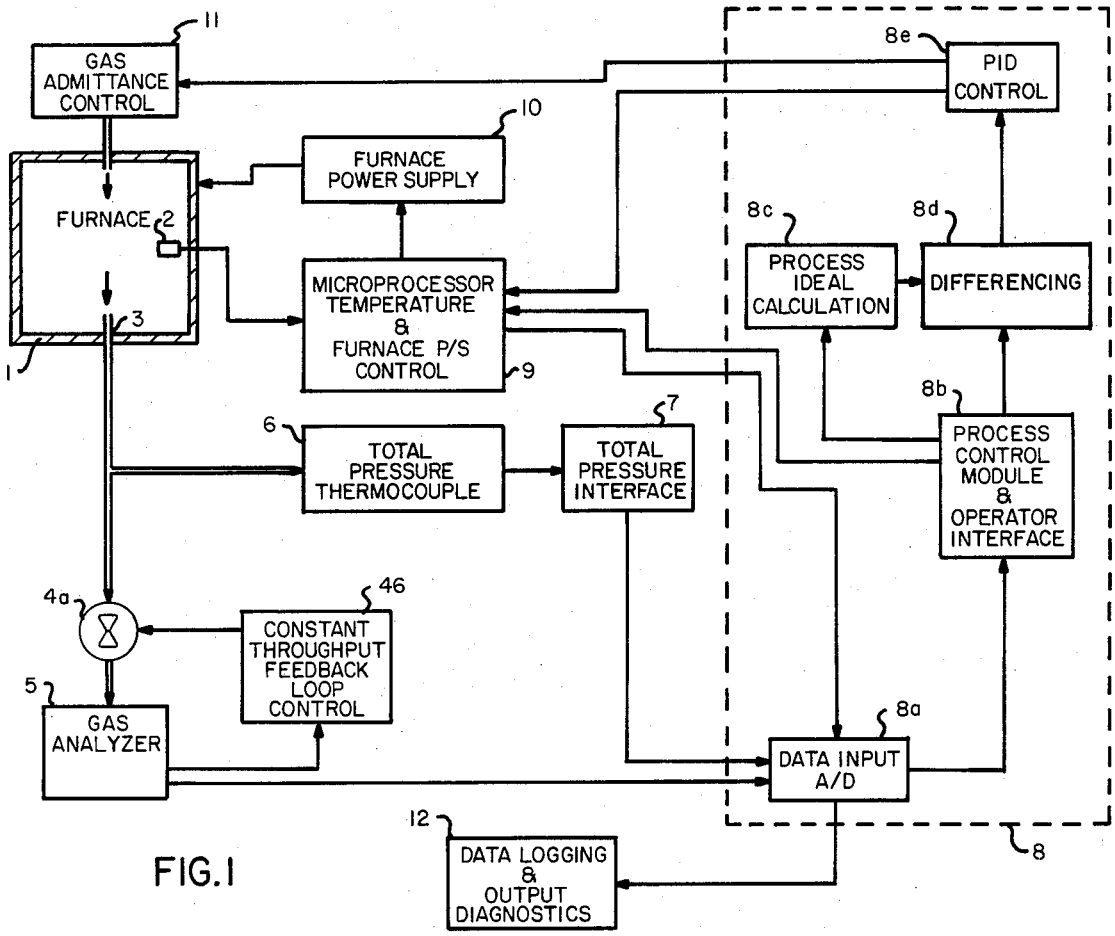
FIG. 1 is a schematic block diagram showing a preferred monitoring and control system according to the invention.

Refering to the drawings and particularly to FIG. 1, there is shown a batch process metallurgical sintering furnace 1 of the type commonly referred to as a vacuum furnace. However, within the general scope of the invention this may be a reduced pressure or higher pressure furnace so long as the gas constituents are also sufficiently variable and distinct as a result of part outgassing. A temperature thermocouple 2 extends into the furnace hot zone as a means for measuring the temperature therein. Conduit 3 provides a means for continuously withdrawing a residual gas sample from the atmosphere of the furnace 1 when the later is in operation. At low pressures, generally from 0.01 Torr to 1 Torr, direct interconnection to the variable gas throughput leak valve 4*a* is sufficient. At higher pressure operations this may be by bypass pumping with or without capillary drop prior to admittance to leak valve 4*a*. Constant throughput leak valve 4*a*, which in the preferred form of the invention is a fast responding piezoelectric leak valve, provides, according to the invention, a constant throughput of gas into the analyzer region of mass spectrometer 5 as controlled by a PID loop 4*b* whose input is the correct operating pressure within the mass spectrometer as determined by an error signal from the mass spectrometer 5.

A total pressure thermocouple 6 is also located in conduit 3 and is connected to a total pressure interface module 7. Both mass spectrometer 5 and total pressure interface module 7 are connected to computer control unit shown within dashed enclosure 8.

The computer control elements include an analog to digital conversion module 8*a* which accepts simultaneous gas channel analog signals from: the gas analyzer 5; the microprocessor temperature measurement means 9 (which is also the furnace power supply control unit); and the total pressure thermocouple interface 7. This information is fed to the process algorithm module 8*b* which: derives parameters applicable to the process functional control scheme from the basic input data supplied from 8*a*; provides for running storage of these derived guantities and/or regression analysis and data smoothing; and allows user input of the algorithm appropriate to the process in question. The process ideal module 8*c* calculates and/or formats ideal process parameters analogous to those drived from the real time measured data in 8*b*. The constructs of 8*c* may be user determined empirical parametric information input via the user interface in 8*b* as well as theoretical analytical constructs which may be functions of the furnace total pressure and temperature for example. The process parameters calculated by 8*b* and 8*c* are compared by differencing module 8*d* resulting in a signal which is proportional to changes needed either in initiating a change in the baseline process temperature ramp rate or in analog metering of appropriate gases into the furnace. Proportional-integral-derivative (PID) control module 8*e* provides digital filtering techniques to accomplish closed loop control of the furnace 1 via the process measured parameters and ideal constructs which are differenced by module 8*d*.

Thermocouple 2 is connected to temperature measurement and control microprocessor 9 as is computer control unit 8*e* via an RS-232 serial data link which allows remote reprogramming of the baseline temperature profile and other standard control parameters from the user interface of 8*b*. Microprocessor temperature control 9 is connected via its output analog signal to furnace power supply 10 which variably controls the heating power in furnace 1. Computer PID control unit 8*e* is also connected to gas control device 11 for variable control of gases admitted to the atmosphere of furnace 1.

A data logging and diagnostic recording device 12 is connected to computer control unit 8 for displaying the data in real time from the computer control unit. For process development this data may be stored on magnetic tape for later data compression and graphical display of derived quantities such as are calculated for real-time control by modules 8b and 8c. This capability is valuable in process development as well as for subsequent feedback to process algorithm module 8b as an empirical comparison standard, having been previously logged following the determination of optimal process conditions. In the realization of a working prototype, the computer acquisition and control designated by 8 was accomplished by the use of two interactive IBM personal computers.

The invention makes use of the information obtained from measurement of the percent composition of gases in the environment of sinter furnace 1. In the preferred form of the invention this is accomplished by parallel detection of each atmospheric gas channel by mass spectroscopy. Thus, adequate and predetermined sensitivity must be obtained for turnkey operation, as is easily accomplished in the preferred form of the invention, for the channels of interest—primarily $N_2$, $O_2$, $H_2$, $H_2O$ and $CO_2$ and $CH_4$ but also in some cases it has been observed that some hydrocarbon channels, specifically in the case of tungsten carbide, atomic mass units 41, 42 and 43 as a combined channel, are significant, as we have determined as an indicator of lubricant removal completion. However, depending upon the process, other mass channels are used as appropriate.

The gas of interest, which can, for example, deplete from the sintered parts in furnace 1, may also exist as a small percentage of the total pressure in the furnace as in the case of $N_2$ for detection in the real time determination of densification. This being the case a mass scan, with an instrument such as a serial scan mass spectrometer with constant electrometer gain so as not to saturate on the predominant channels, will show little signal for the channels of interest and, naturally, any attenuation is hard to see. This is commonly encountered when one simply hooks up a conventional mass spectrometer to a sinter furnace to have a "look" at the gas levels—the effect may not be noticed since the information of interest may not be the primary component of the furnace gas load. This aspect is important since part outgassing may be more important in terms of its diagnostic information as to the state of the part rather than in the chemical effect of such outgassing on the furnace atmosphere. Thus, relatively small components of the furnace total atmosphere may have the most control significance via the furnace temperature.

It is also important to look at an output reading of a gas in the furnace 1 in terms of percent composition of the furnace atmosphere. Consider the situation where the throughput to the mass spectrometer is adjusted manually or is constant. Since in a vacuum sinter furnace environment the total pressure may be continually changing—but not necessarily the percent composition—a simple measurement of partial pressure may show dynamic behavior when, in fact, the true percent composition is constant. This problem has been solved in accordance with this present invention by the use of a piezoelectric constant throughput leak valve 4a. Valve 4a is in closed loop control by the mass spectrometer 5 itself via the constant throughput feedback loop control 4b, so as to effect a constant throughput into the analyzer region. Thus, the total throughput of furnace gas to mass spectrometer 5 is independent of the variations in sinter furnace 1. This feature of valve 4a provides true percent composition output when coupled with an AGC circuit from the mass spectrometer means to remove any remaining throughput variation. Thus constant pressure is held in the mass spectrometer.

Basically, the closed loop feedback control and characterization system of this invention can utilize known units for mass spectrometer 5, microprocessor temperature controller 9 and gas control device 11 although other partial pressure transducer types can be used. In the preferred embodiment of the invention and in previous experimental demonstrations a commercial industrialized mass spectrometer was adapted as described above. This unit is designed for turnkey operations at the plant level. The modified basic mass spectrometer is the MGA produced by the Perkin-Elmer Corporation, Pomona, California.

Figure 2:
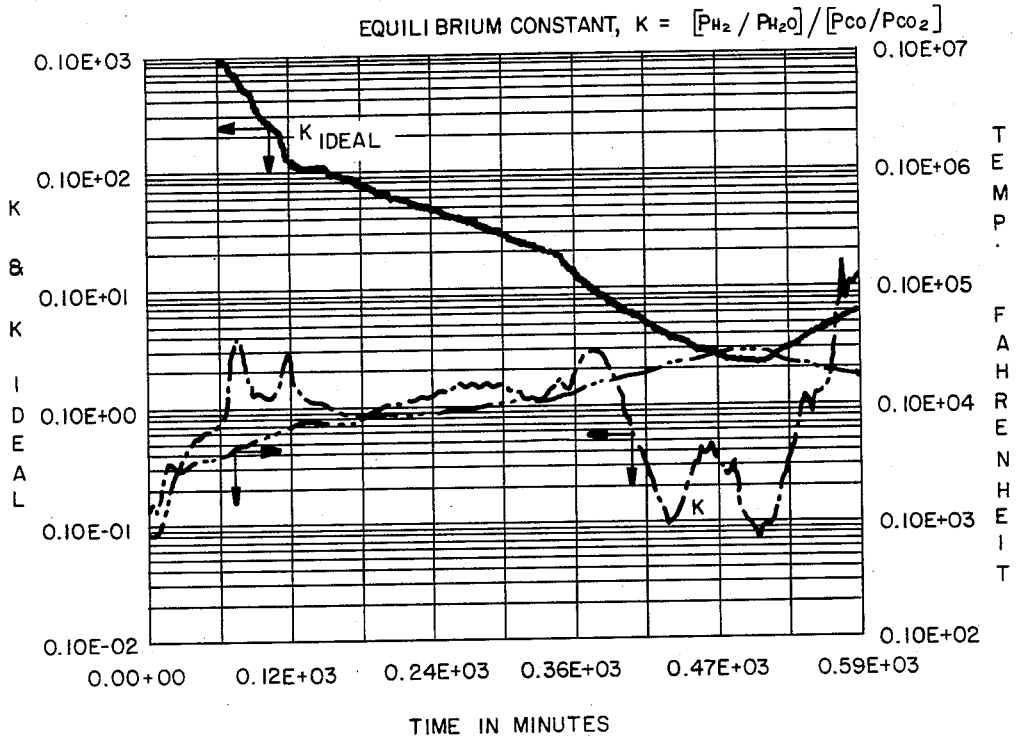
FIG. 2 is a set of curves illustrating typical closed loop control-input data of derived quantities from measured furance gas composition for tungsten carbide sintering, in this case the water-gas equilibrium constant is displayed, with the corresponding theoretical value calculated from the measured furnace temperature.

In a typical application for the sintering of tungsten carbide with process control the unit operates by sampling effluent gas from the furnace 1. Computer control unit 8 performs a regression analysis, after digitization, on the particular mass channels for which the gas evolution profiles are most indicative of instantaneous sinter conditions; calculates equilibrium constants and appropriate indicative gas ratios, such as hydrocarbon channels, the water gas equilibrium constant, and the value of $[PCH_4/PH_2^2]$; computes deviation from desired performance; and by a combination of feedforward and feedback techniques via external interfaces to gas control device 11 for gas admittance and temperature measurement and control microprocessor 9 for temperature ramp control on the sinter furnace 1, regulates the process for optimum results. The unit also has important utility in furnace condition characterization which can significantly vary in ambient gas content over longer time periods. This makes possible active atmosphere control to normalize conditions. In operation, all these tasks can be performed using readily available components. FIG. 2 shows a typical output from the data logging diagnostic 12 for the ideal and measured water gas equilibrium constant, $$K = \frac{[P_{H2}/P_{H2O}]}{[P_{CO}/P_{CO2}]}$$

in a tungsten carbide furnace working in a nonoptimal condition.

Figure 3:
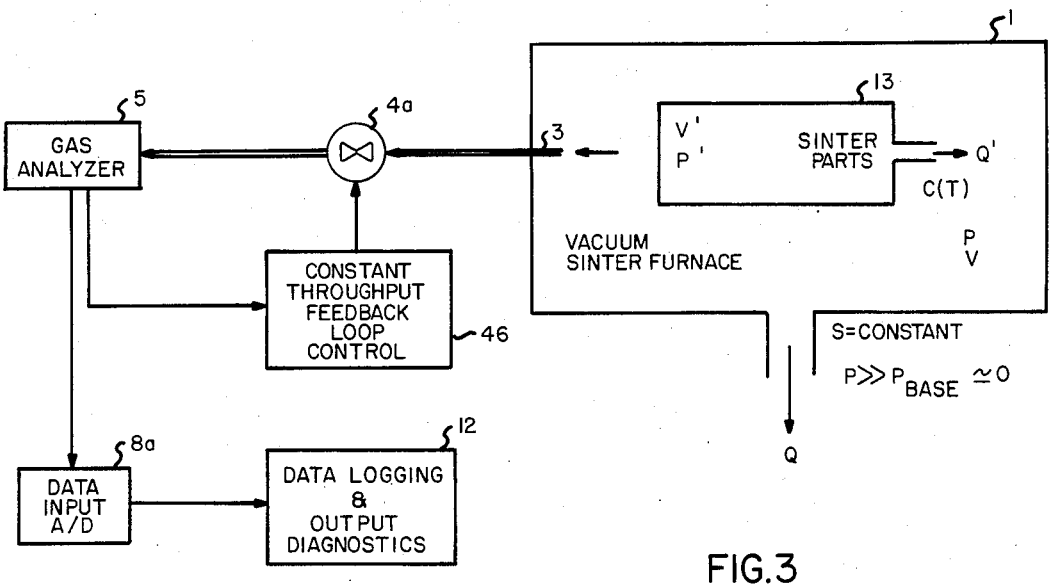
FIG. 3 is another schematic block diagram illustrating the densification determination aspect of this invention; and, FIG. 4 is a sample attentuation curve for tungsten carbide sintering illustrating the densification and part temperature variation determination aspects of the invention for a non-uniform temperature hot zone.

The powder metallurgy densification determination technique of the invention makes use of the same measurement equipment as the foregoing. This technique can be described in more detail with reference to FIG. 3 wherein there is shown schematically a sinter part 13 having a volume V' representing the predensification internal pore volume of the parts to be sintered. The internal sinter part pressure is P'; whereas, the vacuum sinter furnace 1 of volume V has a pressure P. The furnace pumping conductance or speed is S.

Assuming no adsorption or outgassing in the furnace 1 itself, the throughput of gas Q out of the sinter furnace 1 will equal that out of the parts, Q', if it is assumed the time constant for equilibration within the furnace is much faster than within the insert: $\tau = V/S$ where V and S are the volume and pumping speed of the furnace respectively. Then the throughput is given by $Q' = C(T)*(P' - P)$ where C(T) is the net conductance of the sinter part 13 at a given stage of densification and thus part temperature T.

Since the throughput out of the furnace, Q, neglecting the base pressure of the system pump, $P_{BASE}$ is given by Q=SP, the result is that the furnace pressure is related to the average pressure internal to the part 13 (in the pores) as $$P=[C(T)\,P']/[S+C(T)] \quad (1)$$

As pore closure occurs and thus C(T) drops to zero, the measured outgassed partial pressure in the furnace will correspondingly drop so long as the part internal pore gas pressure P' remains constant or decreases. This, in fact, is generally the case.

The origin of the part outgassing (separate from the effect of residual furnace contamination) is atmospheric contaminations during powder manufacturing and sinter part pressing. However, binder/lubricant material can have an effect on the type and quantity of this outgassing. Deliberate gas doping of parts during pressing or the like for the above described diagnostic purpose is also feasible. In any case, it is believed that the outgassing rate can be related to the rate equation for thermal desorption (Polyani-Wagner equation)

$$Q\sim(d\sigma/dt)=\sigma_0\theta^n T\exp(-E_D kT) \quad (2)$$

where $\sigma$=surface coverage in molecules/cm$^2$ $\sigma_0$=constant $\theta=\sigma/\sigma_0$ n=order of the desorption process of value 1, 2, 3 depending on the surface recombination mechanism $E_D$=energy required for desorption k=Boltzmann constant T=temperature of the surface Thus, the internal sinter part pressure, P', is seen to depend upon how fast the temperature is changed during the period of pore closure as well as the molecular surface coverage during this period.

It has been observed emperically, as would be expected from the above equation commencing at some characteristic temperature, that an increasing outgassing effect exists above the background once kT is comparable to the desorption energy $E_D$. This occurs in FIG. 4 which is a typical result obtained for tungsten carbide sintering by measurement of the nitrogen percent composition prior to and during the densification phase starting at approximately 1640° F. This curve also shows a double peak structure which is characteristic of a radical temperature variation (bi-modal in this case) among the parts and thus the superposition of the nitrogen attenuation occuring at differing times for individual parts. In the case of the densification determination for uniformly heated parts, for example, only one hump is observed. Once the surface coverage and/or gas depletion sufficiently decreases, the outgassing rate can again become constant or decreasing as in the top of the curve for FIG. 4.

Figure 4:
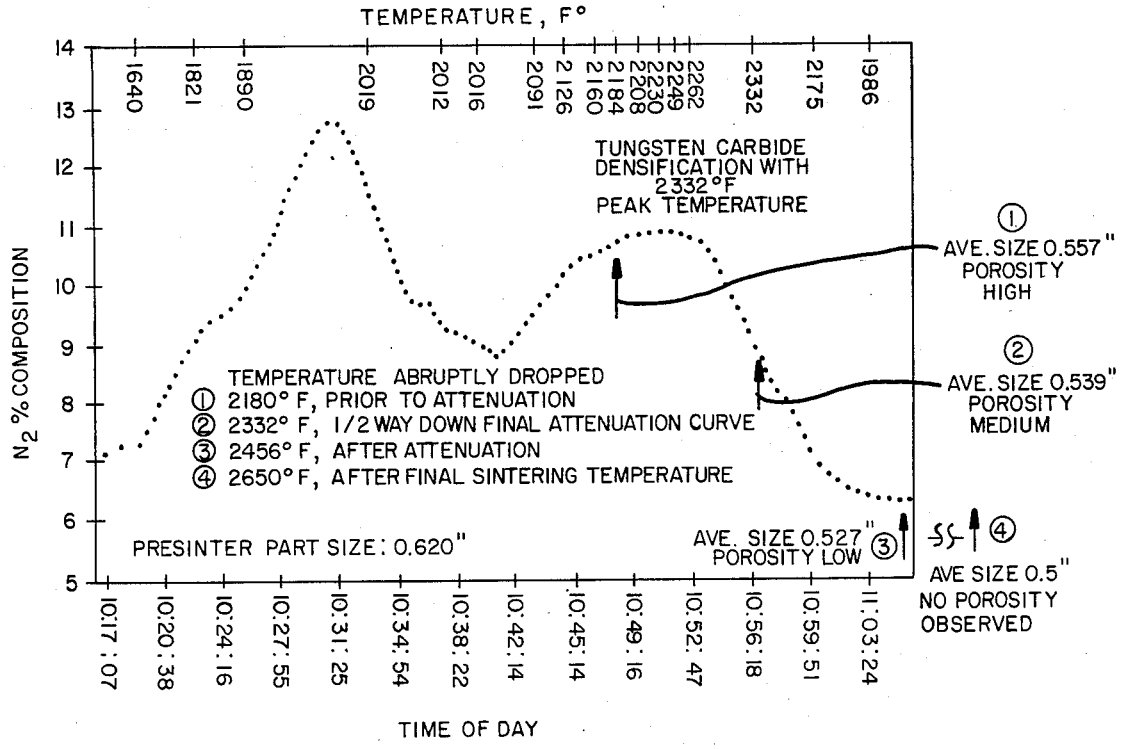

The Polanyi-Wagner equation expresses the relationship for gas desorption from a material surface for a given gas species with desorption energy $E_D$ which itself is an ensemble average over the appropriate bound states of the gases weighted by their occupancy. In the case of the densification determination it is not clear whether the $N_2$ gas measured as in the case of tungsten carbide shown in FIG. 4 is desorbed from the surfaces of the interstices or somehow being released during the shrinkage process. Nevertheless, equation (2) above can functionally describe a wide variety of processes assuming the parameters are reinterpreted appropriately.

The behavior expected for some continuous functional decrease of C(T) and V' (corresponding to the actual pore closure/densification mechanism) would look like an attenuating curve which is functionally like the later part of the experimentally observed $N_2$ curve of FIG. 4 which decreases as temperature and time increase and, correspondingly, part densification increases. Depending on the Polyanyi-Wagner factor, the internal pore pressure may become quite high even before pore closure, and subsequent to total closure this pressure becomes even higher as pore shrinkage continues until the internal pore pressure is counterbalanced by surface tension. For pores above a certain size, expansion can even occur.

Explicit experiments have been performed to confirm that the attenuation curves actually correspond to the actual real time densification. In these experiments the sinter run was stopped (furnace temperature abruptly dropped) in particular sinter runs at a time corresponding to a particular stage of densification as presumed to correspond to the nitrogen attenuation (just before attenuation begins; the middle of attenuation; just following attenuation; etc.). Subsequent to these heats, the corresponding parts were measured for physical size and photomicrographs prepared of residual pore density. FIG. 4 shows that both the size of the part and the pore density functionally tracked the nitrogen attenuation curves becoming essentially the values known for the complete sintering process for those parts stopped just after the attenuation was complete. The value obtained for a premature termination run, is shown at the corresponding location on the typical curve of FIG. 4. This curve was obtained for the sinter run stopped just prior to the point at which the attenuation was complete. As indicated those parts stopped just before the attenuation started had sizes nearer to the unsintered parts and high residual porosity.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A method of determining the dimensional shrinkage characteristics and part uniformity of an article being sintered in real time in a metallurgical or ceramic furnace during said operations comprising:

a. withdrawing a gas sample from the atmosphere of said furnace; and, b. measuring the percent composition of a component of said gas sample, said component being comprised of a gas at least in part undergoing attenuation in conductance from said part due to pore closure during densification.

2. A method according to claim 1 wherein said gas component is nitrogen.

3. A method according to claim 1 wherein said gas is of a type and quantity within the part to be processed in said furnace as determined by deliberate doping at the time of powder pressing for powder metallurgy sintering.

4. A method according to claim 1 wherein the output information on part shrinkage in powder metallurgy is used for in situ calibration of the actual part temperature relative to furnace temperature as read by a thermocouple system.

5. A method according to claim 1 wherein the output information on part shrinkage in powder metallurgy is used to determine the spatial uniformity of the specific sinter stage of individual parts in the furnace, said variation due to furnace temperature inhomogeneity or part composition inhomogeneity, and evaluated by deconvolution of said data which results from superposition of the attenuation of outgassing from each part in the furnace.

6. A method for the monitoring and control of a batch process metallurgical sintering furnace comprising:

a. continuously withdrawing a gas sample from the atmosphere of said furnace;

b. measuring the percent composition of certain constituents of said gas sample;

c. continuously varying the throughput of said gas sample to a means for measuring the partial pressure of certain constituents, whereby variations in furnace total pressure will not effect measurement of the percent composition of said constituents;

d. measuring the temperature in said furnace;

e. measuring the total pressure in said furnace;

f. comparing said percent composition with predetermined values;

g. comparing derived quantities which are functions of measured temperature, total pressure, and percent composition with predetermined values as determined by batch specific optimal process parameters;

h. controlling the furnace temperature rate with time in response to said measured values; and, i. controlling the input gases to said furnace in response to said derived quantities.

* * * * *